US007282863B2

(12) United States Patent
Garbowicz et al.

(10) Patent No.: US 7,282,863 B2
(45) Date of Patent: Oct. 16, 2007

(54) AUXILIARY QUARTZ LAMP LIGHTING SYSTEM FOR ELECTRONIC HIGH INTENSITY DISCHARGE LAMP BALLASTS

(75) Inventors: Glenn Garbowicz, Algonquin, IL (US); Thomas J. Mayer, Wisconsin Dells, WI (US)

(73) Assignee: Varon Lighting Group, LLC, Elmhurst, IL (US)

( * ) Notice: Subject to any disclaimer, the term of this patent is extended or adjusted under 35 U.S.C. 154(b) by 137 days.

(21) Appl. No.: 11/178,785

(22) Filed: Jul. 11, 2005

(65) Prior Publication Data

US 2007/0007907 A1 Jan. 11, 2007

(51) Int. Cl.
*H05B 41/46* (2006.01)

(52) U.S. Cl. ..... 315/92; 315/313; 315/250; 315/307

(58) Field of Classification Search ..... 315/88, 315/91, 92, 93, 291, 307, 312, 313, 250; 362/13, 20
See application file for complete search history.

(56) References Cited

U.S. PATENT DOCUMENTS

| | | | | |
|---|---|---|---|---|
| 3,927,348 | A | 12/1975 | Zawadski | 315/88 |
| 3,976,910 | A | 8/1976 | Owens et al. | 315/92 |
| 4,005,331 | A | 1/1977 | Horowitz | 315/92 |
| 4,996,463 | A * | 2/1991 | Horowitz | 315/250 |
| 5,300,863 | A | 4/1994 | Mayer | 315/88 |
| 5,430,354 | A * | 7/1995 | Garbowicz et al. | 315/92 |
| 5,453,666 | A * | 9/1995 | Brown | 315/91 |
| 6,072,286 | A * | 6/2000 | Sears | 315/313 |
| 6,489,729 | B1 * | 12/2002 | Erhardt et al. | 315/291 |
| 6,703,795 | B2 | 3/2004 | Johnson | 315/273 |
| 7,109,659 | B2 * | 9/2006 | Kamoi | 315/88 |
| 7,139,680 | B2 * | 11/2006 | Orozco | 315/86 |
| 2003/0160573 | A1 * | 8/2003 | Johnson | 315/291 |

* cited by examiner

*Primary Examiner*—Douglas W. Owens
*Assistant Examiner*—Ephrem Alemu
(74) *Attorney, Agent, or Firm*—Levenfeld Pearlstein, LLC

(57) ABSTRACT

A method and electronic circuit operate a quartz auxiliary lamp lighting lamp and circuit to light a quartz auxiliary lamp at 120 Vac and 50-60 Hz current connected to an electronic HID ballast operating at a frequency of 100 Hz to over 400 kHz and voltages of from 120 Vac, as provided by a multitap transformer and related circuitry.

10 Claims, 1 Drawing Sheet

AUXILIARY QUARTZ LAMP LIGHTING SYSTEM FOR ELECTRONIC HIGH INTENSITY DISCHARGE LAMP BALLASTS

FIELD OF THE INVENTION

This invention relates to an auxiliary quartz lamp lighting system for a high intensity discharge (HID) lamp ballast. More particularly, this invention concerns an operating circuit for an auxiliary quartz lamp wherein the quartz lamp is ignited when power to the HID lamp is interrupted and the HID lamp is extinguished. Power interruptions of even a very short duration will often cause the HID lamp to be extinguished. After restoration of power, the HID lamp will ignite only after gasses within the HID lamp have sufficiently cooled to allow re-ignition. Auxiliary lighting sources are typically used to provide illumination during the period following power interruption and during the time required to re-ignite.

High intensity discharge (HID) lamps with electronic ballasts are increasingly accepted for commercial and industrial applications illuminating large open spaces such as construction sites, stadiums, parking lots, warehouses, and roadways. As such, an alternative source of exterior illumination source provided by a quartz lamp and its related controller is highly desirable.

These arc lamps can operate at a moderate voltage; a ballast typically limits the current to light the lamp since the voltage appears across the lamp electrodes causing the vapor to break down into a self-maintaining discharge. The ballast limits the current to a safe value since the discharge is not inherently self-limiting. The instant invented auxiliary quartz lighting controller accordingly includes a ballast to control the current to the quartz lamp. The invented auxiliary quartz lighting controller accordingly controls the quartz lamp to initiate illumination when the HID lamp is extinguished and to switch off the quartz lamp when the HID lamp again is at full illumination.

The necessity to control the operation of the quartz lamp in conjunction with the operation of an HID lamp has become a problem because HID lamp circuits use electronic HID ballast circuits. HID lamp circuits have been switching gradually from traditional magnetic ballast circuits to electronic HID ballast circuits.

Semiconductors are used to control output lamp current in electronic HID ballasts. The control elements in the electronic ballasts operate at a higher frequency than conventional ballasts. Electronic ballast systems typically convert alternating current sources having a relatively low frequency in the range of from 50-60 Hz to a higher frequency typically in the range of 100 Hz-400 kHz. The conversion typically involves a two-stage process, wherein AC oscillation having a frequency of 50 to 60 Hz is first rectified to a DC voltage and then this DC voltage is chopped at a higher frequency to produce alternating current in the frequency range of 100 Hz-400 kHz.

BACKGROUND OF THE INVENTION

High intensity discharge lamps require a certain warm-up period, approximately five minutes, before the light output of the high intensity lamp reaches usable levels. Also, if a supply voltage drop is experienced, the high intensity lamp will extinguish and will not again reach a usable light output until after a substantial cool-down period and subsequent restart period; an accumulative period of approximately 15 minutes. In certain applications for these lamps, the period prior to attaining full luminescence after the period subsequent to a supply voltage drop in which the lamp is extinguished can result in substantial inconveniences. In certain specific applications such as hospitals, supermarkets, and department stores, sudden light failure resulting from a voltage drop can cause patients or patrons to expose themselves or others to injury.

Accordingly, control devices for auxiliary lamps have been sought to automatically provide auxiliary lighting when the high intensity discharge lamp is in a low luminescence condition. However, control devices have not been readily available for an auxiliary light source for use with electronic high intensity discharge lamp ballasts to provide supplemental lighting during start-up and cool-down phases of operation of an associated high intensity discharge lamp.

The provision of an auxiliary control circuit for an auxiliary lamp which automatically functions to provide lighting during times when the high intensity discharge lamp is not at full luminescence can encounter an operational frequency mismatch of the 50/60 Hz frequency operation of conventional power supplies and the 100 Hz-400 kHz frequency of operation of high intensity discharge lamp ballasts. Additionally, conventional auxiliary lamps may use a power source of 120 Vac whereas high intensity discharge lamp electronic ballasts operate over a range of voltages of from 120-277 Vac.

Electronic HID ballast systems for HID lamps have been provided as alternatives to traditional magnetic ballasts in both low wattage applications and mid-wattage applications of 50 to 450 watts, although low wattage HID lamps frequently have not used auxiliary emergency lighting sources. Auxiliary quartz lamp lighting systems now are used for mid-wattage (50-450 watts) HID lamps with electronic ballasts.

DESCRIPTION OF THE PRIOR ART

In the prior art, U.S. Pat. No. 3,927,348 to Zawadski teaches and claims a control system for an auxiliary lamp to provide supplementary lighting for a high intensity discharge lamp. The auxiliary lamp control circuit utilizes a single reed switch to control the auxiliary lamp. The flux of a permanent magnet determines operation of the reed switch to deliver a gating signal to a triac transistor to cause the auxiliary lamp to light.

U.S. Pat. No. 3,976,910 Owens et al. teaches and claims a starting and operating circuit for gaseous discharge lamps and an auxiliary incandescent lamp. The circuit comprises an induction coil, a charging capacitor and controlled switch. The controlled switch is a triac transistor having a gate electrode, which when gated causes the switch to conduct and cause a diac transistor to conduct upon application of a breakdown voltage. The actuating circuit is connected to the junction of the induction coil means and the discharge lamp means.

U.S. Pat. No. 4,005,331 to Horowitz teaches and claims an emergency lighting system of a mercury vapor lamp and an incandescent lamp wherein voltage sensitive relays operate when the voltage across the mercury vapor lamp achieves a predetermined value. Normally closed contacts of a relay across the mercury vapor lamp are in series with the incandescent lamp.

U.S. Pat. No. 4,996,463 to Horowitz teaches and claims an auxiliary lighting system to be used with a high intensity discharge lamp having a solid-state electronic ballast and an auxiliary lamp which is connected to a source of power through normally closed contacts of a relay coil in the input line to the solid-state ballast. Above a predetermined threshold current to the ballast, the relay coil causes the normally closed contacts to open to extinguish the auxiliary lamp. Below a threshold current to its ballast, the closed contacts cause the auxiliary lamp to turn on.

U.S. Pat. No. 5,300,863 to Mayer teaches and claims an auxiliary lighting circuit for a gaseous discharge lamp and an auxiliary lighting source comprising a current transformer comprising primary and secondary coils. The primary coil of the current transformer of the auxiliary lighting circuit is in series between the gaseous discharge lamp and main power source to produce a voltage in the secondary coil of said transformer as an auxiliary power source. A first gated triac transistor is in series between the auxiliary power source and the auxiliary light source. A second gated triac transistor is coupled between the first gated triac and said current transformer such that the first gated triac is non-conductive to turn the auxiliary lamp off when current is drawn by the gaseous discharge lamp. When no current is drawn by the gaseous discharge lamp, the first gated triac is conductive, and power is applied to the auxiliary lighting source to turn the auxiliary lamp on.

U.S. Pat. No. 5,430,354 to Garbowicz teaches and claims a ballast for lighting a first lamp and a second lamp. It comprises a current control means responsive to flow of current there-through for controlling current through the first lamp, a switching control means responsive to a switching signal including a triac transistor having a gate and an opto-coupler connected to said gate for supplying a switching signal to said switching means.

U.S. Pat. No. 6,703,795 B2 to Johnson teaches and claims an auxiliary lighting system to illuminate an auxiliary lamp to supplement a high intensity discharge (HID) lamp from the time the HID lamp is activated until the HID lamp achieves full illumination. The lighting system includes a primary lamp circuit, an auxiliary lamp circuit and an auxiliary controller. The auxiliary controller is connected between the primary lamp circuit and the auxiliary lamp circuit to sense a voltage of the primary lamp circuit. When the said voltage exceeds a threshold voltage, the auxiliary lamp is extinguished. The auxiliary controller includes a power supply circuit, a switching circuit and a coupling circuit. The power supply circuit has input and output voltage. The switching circuit has open and closed states. The coupling circuit may have an optically isolated triac transistor that has open and closed states. The triac transistor may be triggered into conduction when a breakover voltage on a diac transistor is exceeded.

Accordingly, in the prior art it is well known to provide a control system for an auxiliary lamp, which provides supplementary lighting for a high density discharge lamp. In general, it is well-known to use a triac transistor having a gate as a switch device to determine the operation of an auxiliary lamp, as well as a reed switch and voltage sensitive relays. It is also well-known to use voltage levels and/or current levels as determinate means to activate the switch devices.

In general, it is therefore well-known to provide a source of the switching signal by a sensing circuit across the terminals of the HID lamp (U.S. Pat. No. 3,927,348); an induction coil connected to the input side of an alternative current source (U.S. Pat. No. 3,976,910); the current level through the high intensity discharge lamp (U.S. Pat. No. 4,005,331); the current flow drawn by a high intensity discharge lamp (U.S. Pat. No. 5,300,863); a switching signal provided by an opto-coupler in response to current drawn by the high intensity discharge lamp (U.S. Pat. No. 5,430,354); and a switching signal provided by a voltage change when the high intensity discharge lamp voltage exceeds a certain threshold (U.S. Pat. No. 6,703,795).

While the above circuits provide control means for an auxiliary lamp in conjunction with an HID lamp and means of providing a control signal to activate the control means have reference to current and voltage levels, differences exist in the switching means providing the voltage or current level required. Control circuits designed for 50/60 Hz operations typically do not function at the output frequency of electronic ballasts, typically 100 Hz-400 kHz, used in the mid-wattage HID lamps (150-450 watts).

The current invention provides a circuit and method for timely operating an auxiliary lamp comprising a quartz lamp at 120 VAC 50/60 Hz as an auxiliary lighting lamp for use with high intensity discharge lamps using electronic HID ballasts in the mid-wattage range of 150-450 watts wherein the HID ballast output is an output frequency of typically 100 Hz-400 kHz and higher.

While the above discussed prior art references disclose methods of activating and controlling lighting of auxiliary lamps in conjunction with HID lamp installations, none are known to the inventor which reveal a specific workable circuit and method for achieving and supplying proper voltage and current levels for a quartz auxiliary lamp in conjunction with lighting operation of a HID lamp and an electronic ballast.

SUMMARY OF THE INVENTION

The invention comprises an auxiliary quartz lamp lighting control system to provide supplementary lighting during start-up and cool-down phases of operation of associated electronic ballast HID lamps.

The invention comprises a method and circuit to operate a quartz auxiliary lamp lighting system of 120 vac, 50-60 cycle current based on operation of an electronic high intensity discharge ballast operating at frequencies of from 100 Hz-400 kHz and AC voltages of 120 volts, using a solid-state switch to switch on the quartz lamp when the HID lamp is extinguished and to switch off the quartz lamp when the HID lamp operates to provide full illumination and draws a steady state level of current. The solid-state switch comprises gated triacs activated by current flow to the electronic ballast.

The invention utilizes the sharp increase in threshold current from the current power source, drawn by an electronic ballast of a high intensity discharge lamp when the HID lamp turns on. The increase in the threshold current to the ballast activates an auxiliary quartz lighting controller circuit to cause the quartz lamp to cease to provide auxiliary illumination. The auxiliary quartz lighting controller utilizes said solid-state switch comprising two gated triac transistors as switch devices in conjunction with a diac transistor and a coupled transformer.

The invention accordingly comprises a control system in series with a power source for an electronic ballast of a mid-wattage high intensity discharge lamp. The control system causes a conventional 120 volt 50-60 cycle quartz lighting lamp to illuminate upon failure of the HID lamp to provide illumination and to switch power off to the 120 volt 50-60 cycle quartz auxiliary lighting lamp when the HID lamp operates to provide full illumination. Within the scope of the invention, the invention comprises a method and electrical circuit for providing power to the electronic HID ballast and to the quartz lighting lamp controller comprising a solid-state switch for providing current to the quartz lighting lamp to provide illumination when the HID lamp is not providing illumination and to switch off the quartz lighting lamp when the HID lamp is fully operational.

DETAILED DESCRIPTION OF THE INVENTION

Figure 1:
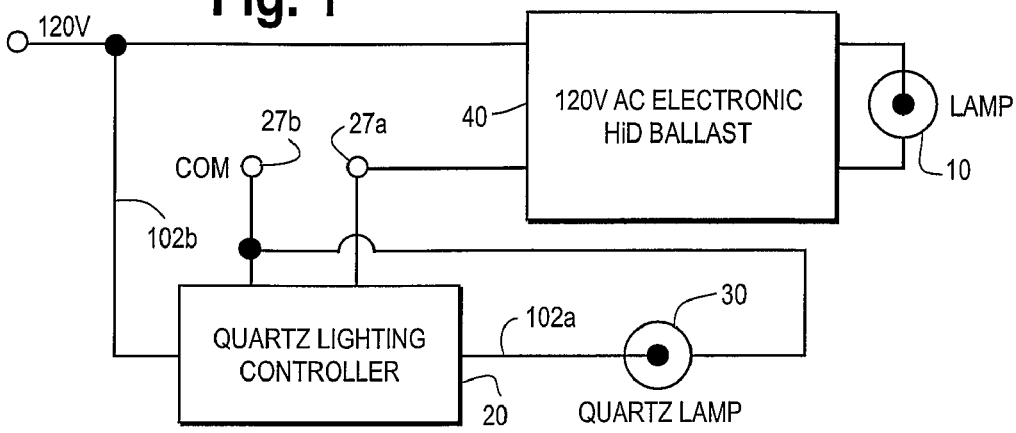
FIG. 1 is a block diagram of the auxiliary quartz lamp lighting system for a high intensity discharge lamp.

FIG. 1 shows a block diagram of conventional high intensity gaseous discharge lamp 10 connected to a 120 Vac electronic high intensity electronic ballast 40 and a quartz lighting controller 20 in series between the 120 Vac power supply and the 120 Vac electronic HID ballast 40. The 120 Vac electronic HID ballast 40 in this particular embodiment which provides a plurality of input taps on the primary winding, e.g., 120 volts, so that different AC voltages from a power source and frequencies of from 100 Hz to more than 400 kHz can be used to operate the high intensity gaseous discharge lamp 10. On the secondary side of the multitap transformer and connected in parallel with lamp 10 is a starter (not shown) for lamp 10.

Figure 2:
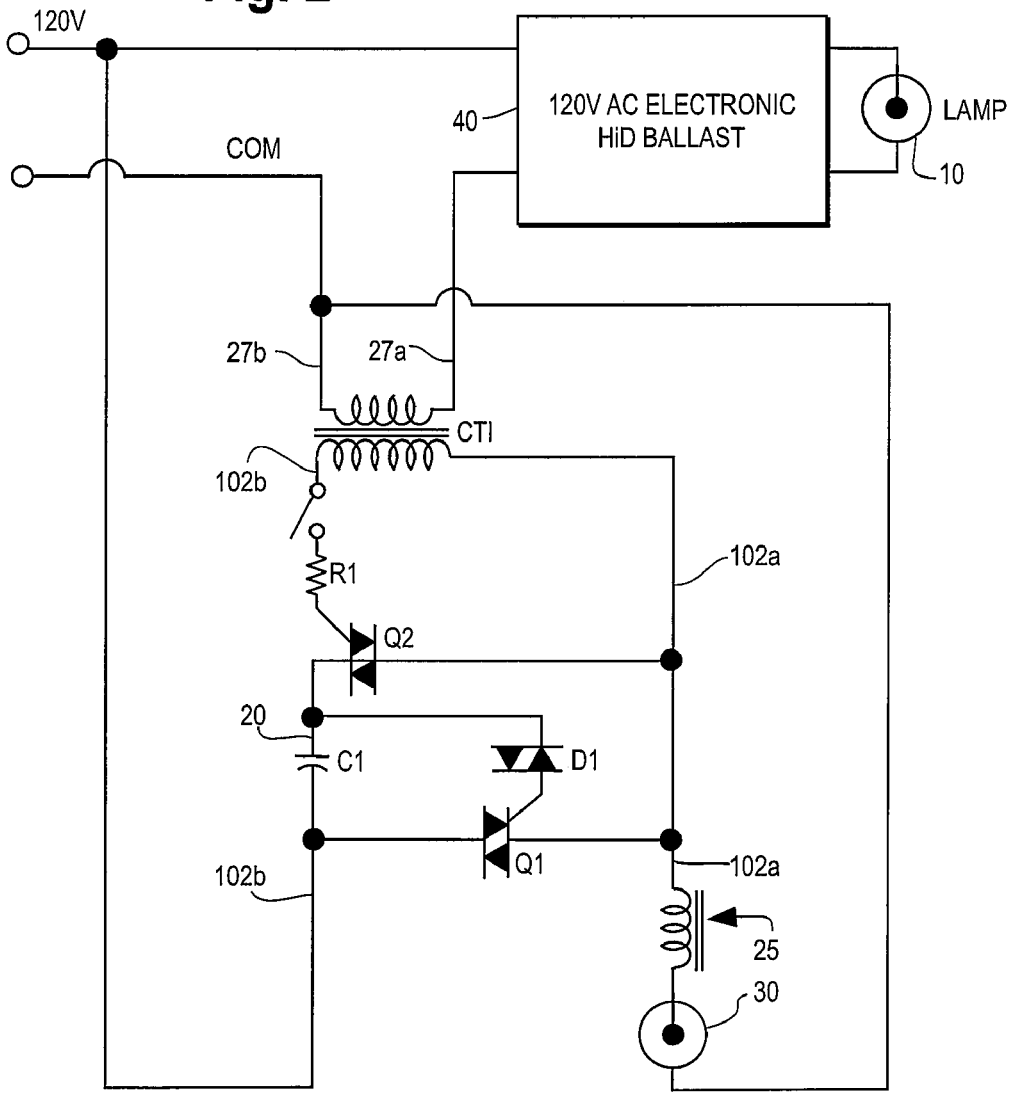
FIG. 2 is a schematic of an auxiliary quartz lamp lighting control circuit in accordance with the present invention.

FIG. 2 illustrates a presently preferred embodiment of the quartz lighting controller 20. Terminal 27*a* is connected in series with the primary side of the 120 Vac electronic HID ballast. Terminal 27*b* is connected to the common conductor of the 120 Vac current source. Terminals 102*a* and 102*b* are connected in series with quartz lamp 30 and its associated ballast 25 and to the 120 Vac power input.

The auxiliary quartz lighting lamp 30, which supplements the high intensity discharge (HID) lamp 10 as an illumination source operates as an illumination source by effectively being "on" at all times except when the auxiliary quartz lighting lamp 30 is caused to be turned "off" by the 120 Vac electronic HID ballast drawing a full power current level to operate the HID lamp 10 at full illumination level after the HID lamp start-up period. The quartz lighting controller 20 operates to turn "off" the auxiliary quartz lamp 30 when the operational level of current drawn by the fully operational HID lamp 10 reaches a predetermined threshold current level as determined by the operational characteristics of the quartz lamp lighting controller 20.

The quartz lighting controller 20 comprises an electronic switch comprising triac Q1 and triac Q2 across the secondary winding of the controller current transformer CTI, which supplies current through the CTI secondary winding to the auxiliary quartz lamp ballast 25 to activate the auxiliary quartz lamp 30. The primary winding of said current transformer CTI for supplying current to the quartz lamp ballast 25 and to the quartz lamp 30 is connected in series with the common input current tap of the primary winding of the multitap transformer of the 120 Vac electronic HID ballast, so that when the electronic HID ballast draws full threshold current to operate the HID lamp at full illumination, the sharp increase in threshold current, hereinafter termed a "step function," causes the quartz lamp lighting controller 20 to cause the quartz auxiliary lamp 30 to cease illumination upon full illumination of the HID lamp 10.

The circuitry of controller 20 comprises two terminals, 27*a* and 27*b*, which are in series with the common input voltage tap of the ballast transformer as noted above. When the electronic ballast is drawing full current to operate the HID lamp 10 at full illumination, the circuitry of controller 20 acts to cause an open circuit across the terminals 102*a* and 102*b* to prevent the auxiliary quartz lamp 30 from operating. The 102*a* terminal is connected in series to the ballast 25 and quartz lamp 30. The 102*b* terminal is connected in series to the 120 Vac power input. An off-on switch of an alternative embodiment not further identified is connected between resistor R1 and one end of the secondary side of transformer CTI.

Controller 20 detects the current drawn by the ballast 40, which current flows through the primary winding of transformer CTI by terminals 27*a* and 27*b*. When the lamp 10 is operating at full illumination and hence drawing full current, the electronic switch of controller 20 acts to open circuit between terminals 102*a* and 102*b*, thus preventing the auxiliary quartz lamp 30 from operating. When the lamp 10 ceases to operate, as indicated by a lower current drawn by the electronic ballast between terminals 27*a* and 27*b*, the solid-state switch of controller 20 provides a conductive path between terminals 102*a* and 102*b*, thus causing auxiliary quartz lamp 30 to illuminate.

Although the operation of the auxiliary lighting circuit has been described with reference to a specific electronic ballast lamp circuit, it should be appreciated that one of the primary advantages of the present invention is that it can be used in conjunction with electronic ballast in virtually any circuit.

In further detail, terminals 27*a* and 27*b* are connected across the primary winding of current transformer CTI, which is preferably a high ratio current transformer. An alternating current through the primary coil of transformer CTI generates a voltage across its secondary coil proportional to the current through its primary coil.

Triac Q1 is connected across terminals 102*a* and 102*b*. One terminal of triac Q2 is connected to terminal 102*a* and the other terminal of triac Q2 is connected to terminal 102*b* through a phase shifting capacitor C1. One side of the CTI secondary coil is connected to terminal 102*a* while the other side is connected to the gate input of triac Q2 through a current limiting resistor R1 and an alternative embodiment off-on switch (not labeled or further identified). The junction between triac Q2 and capacitor C1 is connected to the gate input of triac Q1 through diac D1.

A voltage across the CTI secondary coil due to a current through the CTI primary is thus applied to the gate of triac Q2 to render it conducting. With Q2 conducting, triac Q1 is maintained in the off state since insufficient voltage is applied through diac D1 to the gate input of Q1. Terminals 102*a* and 102*b* are thus effectively open circuited. On the other hand, when current through the CTI primary ceases, no voltage appears across the CTI secondary, which turns triac Q2 off. Terminal 102*b* connected to the auxiliary power source is able to apply a sufficient voltage through capacitor C1 and diac D1 to the gate of Q1 to turn Q1 on and enable current to flow from terminal 102*a* to 102*b*. The auxiliary quartz lamp 30 is thus turned on or off in accordance with the operation of Ballast 40.

In an application of the quartz lighting control system to operate a quartz auxiliary lighting lamp at 120 Vac and 50-60 Hz connected to a magnetic ballast with an input current of 120 Vac and 50-60 Hz for an HID lamp, it was found that the quartz lighting control system was not activated to cause the auxiliary quartz lamp to "turn on." The application demonstrated that magnetic ballast counterparts of electronic ballasts for an HID lamp exhibit a much different input characteristic than does an electronic ballast for an HID lamp. The electronic ballast draws low current when the HID lamp is not illuminated or at less than full illumination and then increases quickly to full current draw upon full lamp ignition. The instant quartz lighting control system utilizes the sharp increase in threshold current to control illumination of the quartz lamp auxiliary lighting lamp. In tests upon a variety of electronic ballasts, the instant invented quartz lighting control system operated successfully to cause the quartz lamp to switch off the quartz lamp when the HID lamp reached full illumination. The instant invented quartz lighting control system has been found to not work properly with a magnetic ballast, because the no-load and fully-loaded input currents of a magnetic ballast are not significantly different to provide a step function. The current difference does not provide a threshold current step function during operation sufficient to trigger the quartz lamp control system to operate.

The step function of an electronic ballast is defined as the sudden change in threshold current drawn by an electronic ballast for a high intensity density (HID) lamp upon full ignition versus current drawn by an electronic ballast for an HID lamp not illuminated or at less than full illumination.

As noted above, electronic HID ballasts operating in the 150-450 watt area exhibit a step function comprising an input current characteristic much different from magnetic ballasts operating in the 150-450 watt area. An electronic ballast for a high density gaseous discharge (HID) lamp draws almost no current when the HID lamp is not illuminated and then jumps to full current upon ignition of the lamp. The instant invented control system senses this step function in current drawn to operate the HID lamp and operates to turn off the auxiliary quartz lamp when the HID lamp draws full current upon full illumination. The instant invented control system is accordingly triggered to cause the quartz 120 Vac 50-60 Hz auxiliary lamp to cease illumination upon full illumination by the HID lamp.

In one particular embodiment of controller 20, particular components are as follows:

1) Current transformer CTI-Model PBSA-2 manufactured by Forest Electric Company of Melrose Park, Ill.; or, Model PN T27Pe manufactured by VXF Transformer Corporation of Bartlett, Ill.;
2) Resistor R1—¼ watt 5% carbon film or composition with a voltage drop across the resistor of 6 Vac or less;
3) Triac Q1—400 volts, 4 amp non-isolated power triac (e.g., Teccor PN Q 400 4F31);
4) Triac Q2—400 volt, 4 amp isolated logic triac (e.g., Teccor PNL401 E3);
5) Diac D1—40 volt, 2 amp diac (e.g., Teccor PN HT-40); and
6) Capacitor C1—0.1 mfd, 400 volt metalized polyester capacitor (e.g., Panasonic PN ECQ-E4104 KZ).

Although the invention has been described in conjunction with the foregoing specific embodiment, many alternatives, variations, and modifications will be apparent to those of ordinary skill in the art. These alternatives, variations, and modifications are intended to fall within the scope of the following appended claims.

In summary, the instant invention comprises a high density discharge lamp control system having an electronic ballast and alternating current power input, an auxiliary quartz lamp and auxiliary quartz lamp controller system for start-up and turn-off modes of operation of said quartz lamp by solid-state switches comprising gated triacs of said auxiliary quartz lamp controller system in response to presence of no input current and full magnitude of input current to said electronic ballast wherein said auxiliary quartz lamp lighting controller system comprises, in combination: (a) a current transformer comprising primary and secondary coils with the transformer connected in the power common input tap of said electronic HID ballast and to said AC power input, so as to produce a voltage in the secondary coil in proportion to the current drawn by the said electronic HID ballast; (b) a first gated triac connected in series between said auxiliary lighting quartz lamp and said power input and said secondary coil providing voltage according to a current drawn by said electronic HID ballast through said primary coil; (c) a second gated triac coupled between said first gated triac and said current transformer such that said first gated triac is rendered to a non-conductive state only when current is drawn by the said high intensity gaseous discharge (HID) lamp and rendered to a conductive state only when no current is drawn by said high intensity gaseous discharge (HID) lamp so as to supply power from said power input to said auxiliary lighting quartz lamp only when no current is drawn by said high density gaseous discharge (HID) lamp; and (d) an auxiliary quartz lamp ballast connected in series to the auxiliary quartz lamp, wherein the second gated triac is coupled to said first gated triac, the gating of said first triac being received through a diac coupled to the second gated triac. The secondary coil of said current transformer is connected as a gating input to the second gated triac, and a phase-shifting capacitor is coupled between the output after said first triac and the output of said second triac to maintain said first triac in the conductive state until the second triac conducts.

In more detail, the instant invention comprises a high density discharge lamp control system having an electronic ballast and alternating current power input, an auxiliary quartz lamp and auxiliary quartz lamp controller system for start-up and turn-off modes of operation of said quartz lamp by solid-state switches comprising gated triacs of said auxiliary quartz lamp controller system in response to the magnitude of input current to said electronic ballast, wherein said auxiliary quartz lamp lighting system utilizes a current step function and a solid-state switch for an auxiliary lighting quartz lamp to a high density gaseous discharge (HID) lamp on electronic HID ballast, wherein the power source is 120 Vac at 50-60 Hz and the 120 Vac electronic ballast comprises frequencies of from 100 Hz to over 400 kHz, wherein said auxiliary quartz lamp controller system comprises, in combination: (a) a current transformer having primary and secondary coils with the transformer connected to the power common input tap of said electronic ballast and to said AC power input, so as to produce a voltage in the secondary coil in proportion to the current drawn by said electronic HID ballast; (b) a first solid-state switch having an input and an output and coupled to said secondary coil of said transformer such that a voltage at the secondary coil causes the first switch to electrically close between its input and output, and such that no voltage at the secondary coil causes the first switch to electrically open between its input and output; (c) a second solid-state switch coupled to the first solid-state switch, and having an input and output, such that when the first solid-state switch is closed between its input and output, the second solid-state switch is substantially always open between its input and output, and when the first solid-state switch is open between its input and output, the second solid-state switch is substantially always closed between its input and output; and (d) an auxiliary quartz lamp ballast connected in series to the auxiliary quartz lamp, wherein the first solid-state switch is a triac having a gate element, the second solid-state switch is a second triac having a gate element and being coupled to the first triac with the gate element of the second triac being connected through a diac to the first triac output, the secondary coil of said current transformer is connected to the gate element of the first triac, the secondary coil of said current transformer is connected to the gate element of the first triac through a current limiting resistor, and a phase-shifting capacitor coupled between the output of the first triac and the output of the second triac.

What is claimed is:

1. In a high intensity discharge lamp control system having an electronic ballast and alternating current power input, an auxiliary quartz lamp and auxiliary quartz lamp controller system for start-up and turn-off modes of operation of said quartz lamp by solid-state switches comprising gated triacs of said auxiliary quartz lamp controller system in response to presence of no input current and full magnitude of input current to said electronic ballast wherein said auxiliary quartz lamp lighting controller system comprises, in combination:

a) a current transformer comprising primary and secondary coils with the transformer connected in the power common input tap of said electronic HID ballast and to said AC power input, so as to produce a voltage in the secondary coil in proportion to the current drawn by the said electronic HID ballast;

b) a first gated triac connected in series between said auxiliary lighting quartz lamp and said power input and said secondary coil providing voltage according to a current drawn by said electronic HID ballast through said primary coil;

c) a second gated triac coupled between said first gated triac and said current transformer such that said first gated triac is rendered to a non-conductive state only when current is drawn by said high intensity gaseous discharge (HID) lamp and rendered to a conductive state only when no current is drawn by said high intensity gaseous discharge (HID) lamp so as to supply power from said power input to said auxiliary lighting quartz lamp only when no current is drawn by said high density gaseous discharge (HID) lamp; and d) an auxiliary lamp ballast connected in series to the auxiliary quartz lamp.

2. The auxiliary lighting system as set forth in claim 1, wherein the second gated triac is coupled to said first gated triac, the gating of said first triac being received through a diac coupled to the second gated triac.

3. The auxiliary lighting system as set forth in claim 1, wherein the secondary coil of said current transformer is connected as a gating input to the second gated triac.

4. The auxiliary lighting system as set forth in claim 1, further comprising a phase-shifting capacitor coupled between the output after said first triac and the output of said second triac to maintain said first triac in the conductive state until the second triac conducts.

5. In a high intensity discharge lamp control system having an electronic ballast and alternating current power input, an auxiliary quartz lamp and auxiliary quartz lamp controller system for start-up and turn-off modes of operation of said quartz lamp by solid-state switches comprising gated triacs of said auxiliary quartz lamp controller system in response to the magnitude of input current to said electronic ballast, wherein said auxiliary lighting quartz switch utilizes a current step function and a solid-state switch for an auxiliary lighting quartz lamp to a high density gaseous discharge (HID) lamp on electronic HID ballast, wherein the power source is 120 Vac at 50-60 Hz and the electronic ballast comprises 120 Vac at frequencies of from 100 Hz to over 400 kHz, wherein said auxiliary quartz lamp controller system comprises, in combination:

a) a current transformer having primary and secondary coils with the transformer connected to the power common input tap of said electronic ballast and to said AC power input, so as to produce a voltage in the secondary coil in proportion to the current drawn by said electronic HID ballast;

b) a first solid-state switch having an input and an output and coupled to said secondary coil of said transformer such that a voltage at the secondary coil causes the first switch to electrically close between its input and output, and such that no voltage at the secondary coil causes the first switch to electrically open between its input and output;

c) a second solid-state switch coupled to the first solid-state switch, and having an input and output, such that when the first solid-state switch is closed between its input and output, the second solid-state switch is substantially always open between its input and output, and when the first solid-state switch is open between its input and output, the second solid-state switch is substantially always closed between its input and output; and d) an auxiliary quartz lamp ballast connected in series to the auxiliary quartz lamp.

6. A solid-state switch as in claim 5, wherein the first solid-state switch is a triac having a gate element.

7. The solid-state switch as set forth in claim 5, wherein the second solid-state switch is a second triac having a gate element and being coupled to the first triac with the gate element of the second triac being connected through a diac to the first triac output.

8. The solid-state switch as set forth in claim 5, wherein the secondary coil of said current transformer is connected to the gate element of the first triac.

9. The solid-state switch as set forth in claim 5 wherein the secondary coil of said current transformer is connected to the gate element of the first triac through a current limiting resistor.

10. The solid-state switch as set forth in claim 5, further comprising a phase-shifting capacitor coupled between the output of the first traic and the output of the second triac.

* * * * *

UNITED STATES PATENT AND TRADEMARK OFFICE

CERTIFICATE OF CORRECTION

PATENT NO. : 7,282,863 B2
APPLICATION NO. : 11/178785
DATED : October 16, 2007
INVENTOR(S) : Garbowicz et al.

It is certified that error appears in the above-identified patent and that said Letters Patent is hereby corrected as shown below:

Col 9 line 23-24 should read:

--secondary coil in proportion to the current drawn by said electronic HID ballast;--

Signed and Sealed this

Eighteenth Day of December, 2007

JON W. DUDAS
*Director of the United States Patent and Trademark Office*